US005855315A

United States Patent [19]

Roseth

[11] Patent Number: 5,855,315

[45] Date of Patent: Jan. 5, 1999

[54] RECLOSABLE FOOD CONTAINER

[75] Inventor: Hank Roseth, Fresno, Calif.

[73] Assignee: MasterCraft Packaging Corporation, Fresno, Calif.

[21] Appl. No.: 843,604

[22] Filed: Apr. 16, 1997

[51] Int. Cl.[6] ..... B65D 5/4805; B65D 5/24

[52] U.S. Cl. ..... 229/120.011; 229/114; 229/120.03; 229/120.17; 493/128; 493/162; 493/912

[58] Field of Search ..... 229/120.011, 120.03, 229/120.17, 114, 127; 493/128–132, 162, 912

[56] References Cited

U.S. PATENT DOCUMENTS

| | | | |
|---|---|---|---|
| 205,531 | 7/1878 | Donahue . | |
| 551,901 | 12/1895 | Kinnard | 229/114 |
| 1,058,408 | 4/1913 | Chase | 229/114 |
| 1,104,933 | 7/1914 | Richardson . | |
| 1,644,782 | 10/1927 | Lander | 229/114 |
| 1,726,108 | 8/1929 | Hughes . | |
| 2,597,847 | 5/1952 | Reeser | 229/120.03 |
| 2,634,041 | 4/1953 | Burnett . | |
| 2,651,449 | 9/1953 | Burnett . | |
| 2,697,544 | 12/1954 | Morand | 229/120.011 |
| 2,965,277 | 12/1960 | Prieto | 229/127 |
| 3,092,301 | 6/1963 | Selle | 229/120.011 |
| 3,180,555 | 4/1965 | Barrett . | |
| 3,397,771 | 8/1968 | Fogle | 229/120.03 |
| 3,522,905 | 8/1970 | Wei | 229/127 |
| 3,876,132 | 4/1975 | Kuchenbecker | 229/120.17 |
| 3,983,999 | 10/1976 | Morton | 229/120.011 |
| 4,793,494 | 12/1988 | Gordon, Jr. . | |
| 4,826,016 | 5/1989 | Foster . | |
| 4,944,451 | 7/1990 | Forbes, Jr. | 229/114 |
| 5,411,204 | 5/1995 | DeMay . | |

FOREIGN PATENT DOCUMENTS

| | | |
|---|---|---|
| 1455937 | 11/1976 | United Kingdom . |

*Primary Examiner*—Gary E. Elkins
*Attorney, Agent, or Firm*—Blakely, Sokoloff, Taylor & Zafman LLP

[57] ABSTRACT

A blank for making a single or dual cavity container and the corresponding containers. In a dual cavity embodiment, the blank is scored to define a pair of bottom panels, two pairs of end panels, and a pair each of lateral and opposing side panels. The pair of opposing side panels are connected together along a mutual upper edge. A lid for each respective cavity extends from the first and second lateral side panels, and each lid terminates in a tuck flap for engaging at least one of the corresponding opposing side panels and the corresponding pair of end panels. Each adjacent pair of walls (e.g., end panel–lateral side panel; end panel–opposing side panel) has a gusset integrally formed therebetween. The gussets are appropriately folded and adhered to the outside of one of the adjacent walls. Because both cavities are formed from a unitary blank with no seams below the upper edges of the walls, leakage is prevented when the container is maintained in an upright orientation. Moreover, the single fold lid closure provides adequate containment of the food disposed within the corresponding cavity, yet simplifies the actions required to achieve closure.

11 Claims, 3 Drawing Sheets

RECLOSABLE FOOD CONTAINER

BACKGROUND OF THE INVENTION (1) Field of the Invention

The present invention relates to a reclosable food container suitable for use in the take-out food industry. More particularly, an easily openable and reclosable food container having either one or two cavities which is erected from a single unitary blank.

(2) Related Art

The expansion of the take-out and prepared food industry over the last several years has increased demand for suitable containers. The Chinese food pail is well-known in the take-out food industry. It is preconstructed at the manufacture plant by folding the pre-cut blank and fastening the gussets with glue or metallic wire. This simplifies use by the food seller who need merely fill the container and close the lid. These Chinese food pails typically have a deep narrow configuration which makes them unsuitable for storage of food not intended to intermingle. Moreover, such pails uniformly have a four-panel lid structure which requires four different folding operations and the use of both hands to achieve closure.

Another type of food carton is fashioned in a shallower configuration and an insert divider is used to separate different foods from one another. The divider insert, if permanently attached, e.g., glued, prevents nesting of the boxes during shipment and storage, thereby increasing associated costs. If not permanently attached, the likelihood of leakage of food around the divider increases dramatically. Moreover, in the process of assembling the container, extra time is required by the food seller to locate the appropriate divider and assemble the container. The same four-fold lid structure is also employed by this type of container.

Still another type of food container is fashioned in the form of an open tray for storing a predetermined amount of food. It is erected at the point of purchase from a pre-cut, pre-scored carton blank. These blanks are typically erected by manually performing numerous time consuming folding and tucking operations at the point of sale. The resulting container often leaks at the corner formed by interlocking tabs and slots. Some variations employ glue to secure the adjacent panels, but leaking remains a problem. Such containers are unsatisfactory for packaging many prepared or take-out foods.

In view of the foregoing, it would be desirable to have a reclosable food container with a simplified lid closure. Moreover, it would be desirable to have a reclosable food container having more than a single cavity so that different foods can be segregated without further assembly requirements or cross-contamination.

BRIEF SUMMARY OF THE INVENTION

A blank for making a single or dual cavity container and the corresponding containers are disclosed. In a dual cavity embodiment, the blank is scored to define a pair of bottom panels, two pairs of end panels, and a pair each of lateral and opposing side panels. The pair of opposing side panels are connected together along a mutual upper edge. A lid for each respective cavity extends from the first and second lateral side panels, and each lid terminates in a tuck flap for engaging at least one of the corresponding opposing side panels and the corresponding pair of end panels. Each adjacent pair of walls (e.g., end panel–lateral side panel; end panel–opposing side panel) has a gusset integrally formed therebetween. The gussets are appropriately folded and adhered to the outside of one of the adjacent walls. Because both cavities are formed from a unitary blank with no seams below the upper edges of the walls, leakage is prevented when the container is maintained in an upright orientation. Moreover, the single fold lid closure provides adequate containment of the food disposed within the corresponding cavity, yet simplifies the actions required to achieve closure.

In a single cavity embodiment, the blank is scored to permit the formation of a container analogous to half (assuming cavities of equal size) of the dual cavity container discussed above. The single cavity has a single fold lid structure for easy opening and closing. Both embodiments are preferably assembled and glued at the manufacturing facility and nestable for shipping and storage.

DETAILED DESCRIPTION OF THE INVENTION

Figure 1:
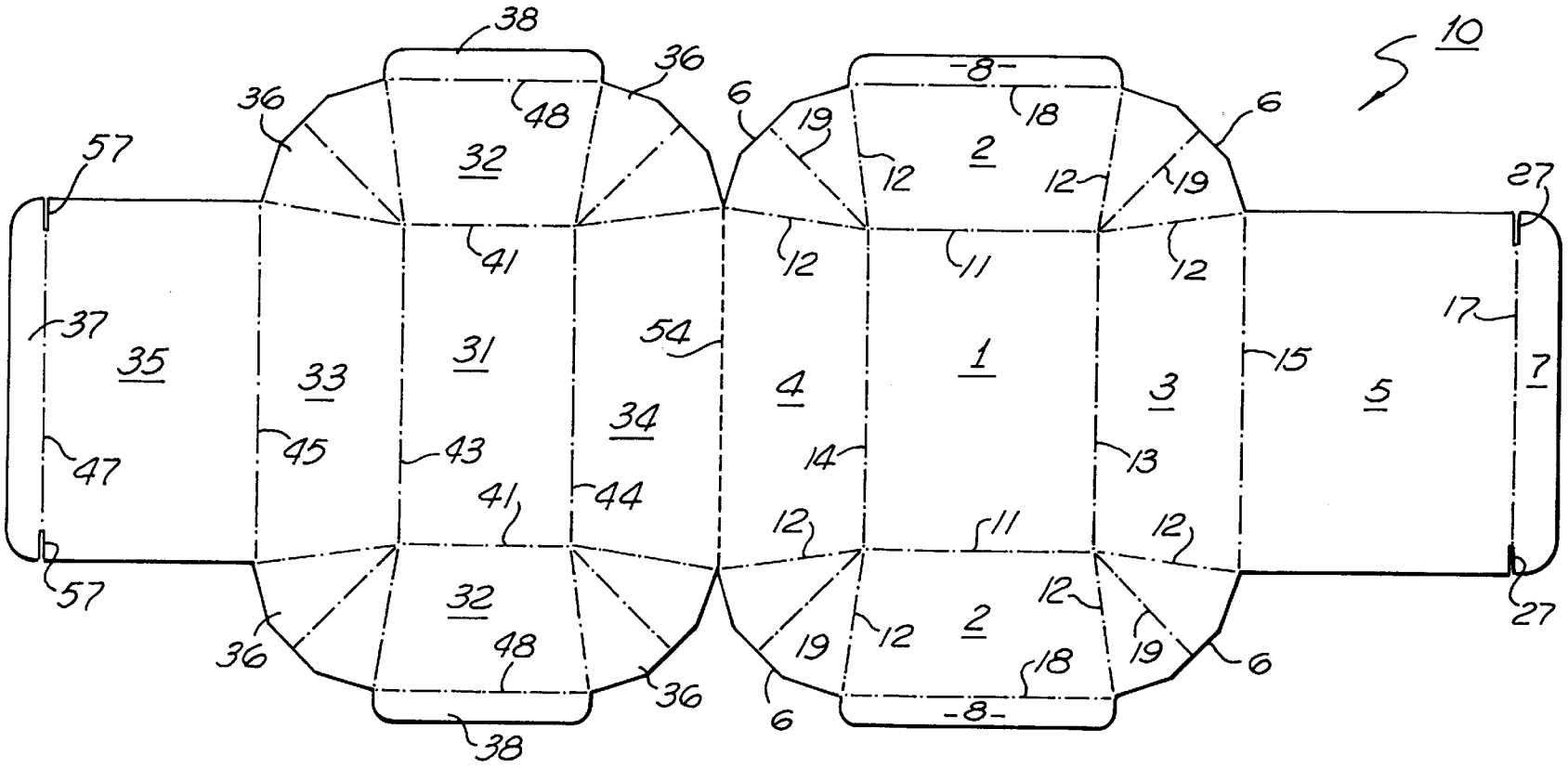
FIG. 1 is a blank of the food container of one embodiment of the invention.

FIG. 1 shows a blank 10 of the food container of one embodiment of the invention. The blank 10 from which a dual cavity container may be formed is punched as a unitary blank from a single sheet of paperboard material suitable for holding, heating, and cooking food. Any paperboard which can withstand the heat generated by a microwave or convection oven is suitable. Suitable paperboard is commercially available and well known in the trade.

The blank 10 has a substantially rectangular first bottom panel 1 which is defined by a first pair of substantially parallel score lines 11 and a second pair of substantially parallel score lines 13, 14. A first pair of end panels extend from the first bottom panel along score line 11. A first pair of splash guard flaps 8 extend from the first pair of end panels 2 and are defined by score lines 18. A first lateral side panel 3 extends from first bottom panel 1 along score line 13. An upper edge of first lateral side panel 3 is defined by a score line 15. A first lid comprising first top panel 5 and first tuck flap 7 extends therefrom. Score line 17 delineates the transition between first top panel 5 and first tuck flap 7. The score line 17 terminates at either end in locking slits 27. First opposing side panel 4 extends from first bottom panel 1 along score line 14. Generically, end panels 2, lateral side panel 3, and opposing side panel 4 are referred to as walls, four gussets 6 extending between adjacent pairs of walls (side–end pairs). Each gusset is defined by a pair of wall edge defining score lines 12 and at least one interior score line 19. By appropriately folding along the score line, a first cavity having a first lid is defined.

The portion of the blank 10 from which a second cavity can be formed is coupled to a first cavity forming portion along a scored line 54 which in one embodiment is perforated or otherwise weakened to make a dual-cavity container manually frangible along that line. The second cavity generally mirrors the first, but need not be of the same size, e.g., second bottom panel 31 defined by pairs of substantially parallel score lines 41 and 43, 44 need not have the same area as bottom panel 1. Second end panels 32 extend from bottom panel 31 along score lines 41. Second lateral side 33 extends from bottom panel 31 along score line 43, the upper edge of which is defined by score line 45, along which a second lid extends. The second lid comprises second top panel 35 and second tuck flap 3 extends. The score line 47 having locking slits 57 at opposing ends defines second tuck flap 37 extending from second top panel 35. Opposing side panel 34 extends from bottom panel 31 along score line 44 and is hingedly connected to opposing panel 4 along a mutual upper edge defined by score line 54. Second splash guards 38 extend from second end panels 32 along score line 48. Gussets 36 are defined between adjacent wall pairs. The blank is expected to be punched and primarily assembled (e.g., gussets glued) at a manufacturing facility prior to shipment to an end user.

In an alternate embodiment, the blank is punched to form a single cavity. In this embodiment, the blank includes only the, e.g., "first," portions of the above-described embodiment For example, the blank would appear as though severed along score line 54. The first cavity is as above described.

Figure 2:
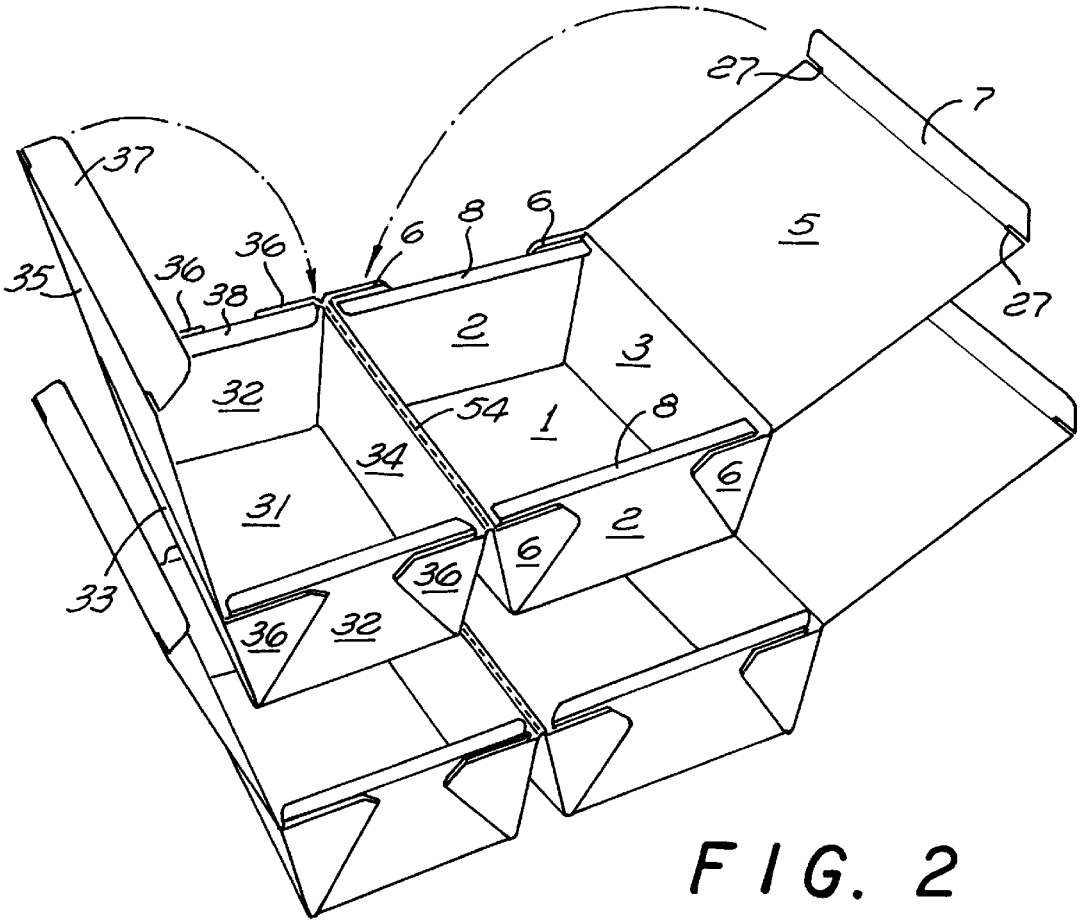
FIG. 2 is a dual-cavity container assembled from the blank shown in FIG. 1.

FIG. 2 shows a dual-cavity container assembled from the blank shown in FIG. 1. The gussets 6 and 36 are folded and adhered to end panels 2 and 32, respectively. When the lid, e.g., comprising top panel 35 and tuck flap 37, is moved to a closed orientation, tuck flap 37 frictionally engages at least one of opposing side panel 34 and/or the pair of end panels 32. Locking slits 57 engage splash guard flaps 38. These two engagements maintain closure so that food placed within the cavity will be retained. An analogous case exists for the first cavity. The fact that each cavity is formed from a contiguous sheet prevents leaking at the corner as long as an upright orientation is maintained. It is preferred, though not essential, that the walls of each cavity are trapezoidal. Thus, the walls 2, 4, 32, 34 slope downward from their upper edges to their intersection with the corresponding bottom panel 1 or 31. This permits the assembled containers to be nested for shipping and storage so as to require less space during such shipping and storage.

Once the blank is punched from a suitable paperboard sheet and appropriately scored, to assemble the container of the first embodiment of the invention, the walls 2–4 are folded upward along score lines 11, 13, and 14 such that the walls 2–4 define a cavity with bottom 1. The gussets 6 are folded along score line 19 such that the gusset 6 is outward from a defined cavity. Each gusset 6 is then folded to be adjacent to an external surface of an end panel 2 and can be attached thereto with a suitable adhesive. It is also within the scope and contemplation of the invention that the gussets 6 may be adhered to the external surface of the side panels 3, 4. Such adhesives are well-known in the art. Splash guard flaps 8 are folded inward so as to extend over a portion of the cavity defined by the walls 2–4 and bottom panel 1. Score line 17 is creased so that when the top panel 5 is folded about score line 15, the tuck flap 7 is positioned to engage the opposing side 4. Analogous steps are undertaken to form the second cavity with bottom panel 31.

Figure 3:
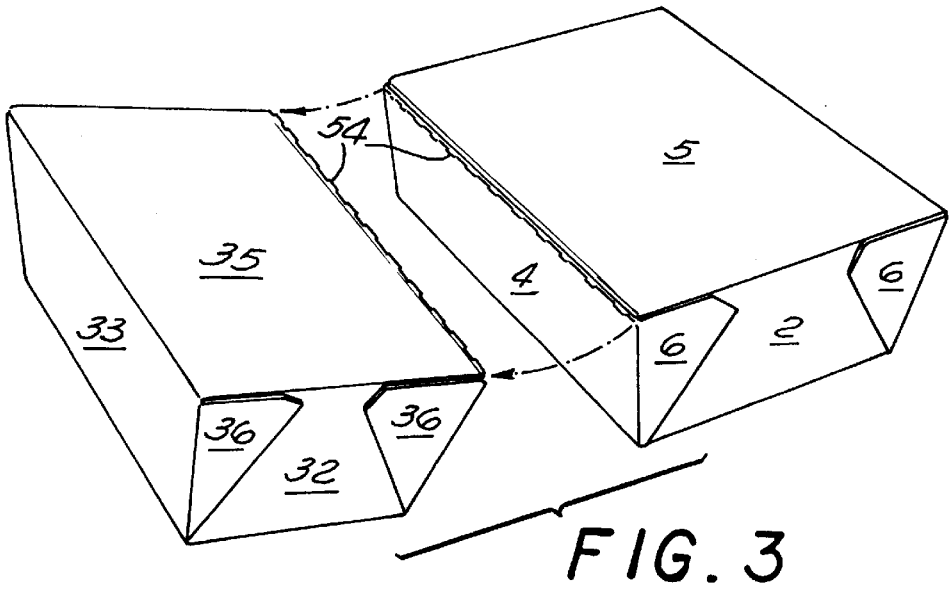
FIG. 3 shows the dual-cavities detached from each other along a frangible line.
Figure 4:
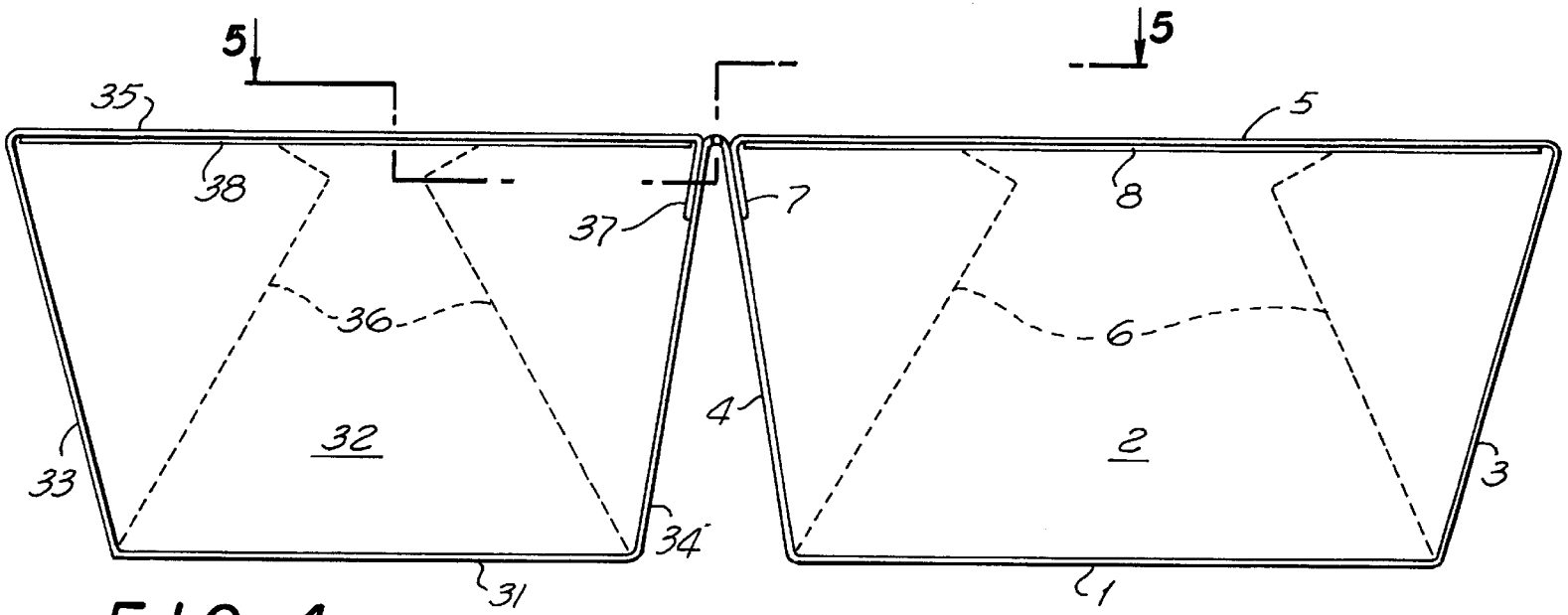
FIG. 4 shows a sectional view of the container of FIG. 2 with gussets in phantom view.
Figure 5:
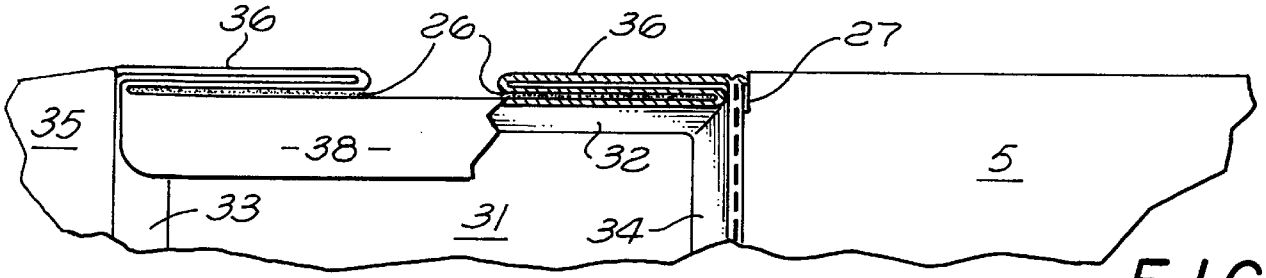
FIG. 5 shows a partial sectional view of the container of FIG. 4.

FIG. 3 shows a container of the blank of FIG. 1 detached along manually frangible line 54 defining the mutually upper edge of opposing side panels 4, 34 such that the first and second cavities are independent of each other. FIG. 4 shows a sectional view of the container of FIG. 2. In this view, the frictional engagement between tuck flap 7 and 37 and opposing sides 4 and 34, respectively, is shown. The gussets 6, 36 are shown in phantom view. FIG. 5 shows a partial sectional view in which gussets 36 are shown adhered to an end panel 32, respectively, by an adhesive 26. The gussets 6 are symmetrically adhered to a corresponding end panel 2 (not shown in this view). It is desirable that an adhesive 26 be such that it does not degrade when reheated in, e.g., a microwave oven. Suitable adhesives are well known in the art.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense. Therefore, the scope of the invention should be limited only by the appended claims.

What is claimed is:

1. A reclosable food container created from a unitary blank, the container comprising:

a first bottom panel;

a first pair of opposing end panels extending from the first bottom panel;

a first lateral side panel extending from the first bottom panel;

a first opposing side panel extending from the first bottom panel on an opposing side to the first lateral side panel;

a first plurality of foldable gussets, each gusset hingedly connecting a side panel–end panel pair;

a first lid extending from the first lateral side panel, the lid engaging at least one of the first opposing side and the first pair of opposing end panels when in a closed orientation;

a second bottom panel;

a second pair of opposing end panels extending from the second bottom panel;

a second lateral side panel extending from the second bottom panel;

a second opposing side panel extending from an opposite side of the second bottom panel as the second lateral side panel and attached along a medial edge to the first opposing side panel;

a second plurality of foldable gussets, each gusset hingedly connecting a side panel–end panel pair; and a second lid.

2. The food container of claim 1 wherein the each lid comprises:

a top panel; and a tuck flap extending from the top panel.

3. The food container of claim 1 wherein the first pair and the second pair of opposing ends each have a pair of opposing splash guard flaps extending therefrom and wherein the tuck flap of the lid engages the pair of opposing splash guards when the lid is in a closed orientation.

4. The reclosable food container of claim 3 further comprising:

a first pair of locking slits formed at opposite edges of a junction between the first top panel and the first tuck flap; and a second pair of locking slits formed at opposite edges of a junction between the second top panel and the second tuck flap, wherein the locking slits increase a retention strength of the engagement between the respective opposing splash guard flaps when the lid is in a closed orientation.

5. The food container of claim 1 wherein the side panels and end panels slope upward at a predetermined angle from the bottom panel such that a pair of food containers are nestable one within another.

6. The food container of claim 1 wherein the medial edge is defined by a manually frangible line.

7. The food container of claim 6 wherein the manually frangible line is a perforated line.

8. The food container of claim 1 wherein an area of the first bottom panel is not equal to an area of the second bottom panel and an area of the first lid is not equal to an area of the second lid.

9. The food container of claim 1 wherein respective ones of the panels are defined on the blank by score lines.

10. A method of making a reclosable food container from a unitary blank comprising the steps of:

scoring the unitary blank with a plurality of score lines at least two of which define a top panel and a tuck flap of a lid;

folding along two pairs of substantially parallel score lines that define a bottom panel;

folding along four sets of score lines, each set defining a gusset extending between pairs of adjacent walls of a cavity;

adhering each gusset to an outer surface of one of the adjacent walls;

wherein the lid extends from a wall of the cavity so as to permit frictional engagement of an opposing wall if folded about the two score lines that define the lid; and repeating the preceding steps for a second cavity having an upper edge of an opposing wall that is shared with the opposing wall of the first cavity.

11. The method of claim 10 further comprising the steps of:

providing locking slits at a junction between the tuck flap and the top panel of each lid; and engaging a pair of splash guard panels with the locking slits.

* * * * *